US009809354B2

(12) United States Patent
Brauer et al.

(10) Patent No.: US 9,809,354 B2
(45) Date of Patent: Nov. 7, 2017

(54) METHOD OF MAKING A WOVEN PLASTIC BAG

(71) Applicant: MONDI Consumer Packaging Technologies GmbH, Gronau (DE)

(72) Inventors: Jochen Brauer, Lohne (DE); Sabine Scheele, Steinfeld (DE); Jens Koesters, Wallenhorst (DE)

(73) Assignee: MONDI CONSUMER PACKAGING TECHNOLOGIES GMBH, Gronau (DE)

( * ) Notice: Subject to any disclaimer, the term of this patent is extended or adjusted under 35 U.S.C. 154(b) by 0 days.

(21) Appl. No.: 14/975,934

(22) Filed: Dec. 21, 2015

(65) Prior Publication Data

US 2016/0176579 A1 Jun. 23, 2016

(30) Foreign Application Priority Data

Dec. 23, 2014 (EP) ..... 14200207

(51) Int. Cl.

| | |
|---|---|
| ***B31B 21/60*** | (2006.01) |
| ***B65D 30/00*** | (2006.01) |
| ***B65D 30/20*** | (2006.01) |
| ***B65D 33/08*** | (2006.01) |

(Continued)

(52) U.S. Cl.

CPC ..... *B65D 29/00* (2013.01); *B31B 19/00* (2013.01); *B31B 37/00* (2013.01); *B65D 31/10* (2013.01); *B65D 33/08* (2013.01); *B31B 2219/23* (2013.01); *B31B 2219/269* (2013.01); *B31B 2219/2681* (2013.01); *B31B 2219/603* (2013.01); *B31B 2219/6007* (2013.01); *B31B 2219/6061* (2013.01); *B31B 2219/62* (2013.01); *B31B 2237/05* (2013.01); *B31B 2237/20* (2013.01); *B31B 2237/403* (2013.01)

(58) Field of Classification Search

None

See application file for complete search history.

(56) References Cited

U.S. PATENT DOCUMENTS

2010/0183830 A1* 7/2010 Berbert ..... B32B 7/06 428/34.8

FOREIGN PATENT DOCUMENTS

DE 4431742 A1 * 3/1996 ..... B31B 29/60
DE 202011080462 A 2/2013

OTHER PUBLICATIONS

DE 102011080462 machine translation, dated Dec. 15, 2016.*
DE 4431742, machine translation, dated Dec. 15, 2016.*

* cited by examiner

*Primary Examiner* — Barbara J Musser
(74) *Attorney, Agent, or Firm* — Andrew Wilford

(57) ABSTRACT

A woven plastic bag is made by longitudinally feeding flat-lying fabric web having a layer of woven-together plastic strips on a first face, opposite longitudinal edge regions spaced transversely from each other and each extending over about 10% of a transverse width of the fabric web, and a middle section between the longitudinal edge regions. A pattern is applied the first face of the fabric web in a pattern that repeats along the production direction only locally with a coating in the form of a film or in the form of a liquid plastic of a width or shape that varies transversely, and the fabric web is shaped into a fabric tube. In order to form individual woven plastic bags, the fabric tube is cut transversely into pieces of the fabric tube suitable for subsequent filling and sealing.

15 Claims, 5 Drawing Sheets

(51) Int. Cl.
*B31B 37/00* (2006.01)
*B31B 19/00* (2006.01)

METHOD OF MAKING A WOVEN PLASTIC BAG

FIELD OF THE INVENTION

The present invention relates to a woven plastic bag. More particularly this invention concerns a method of making such a bag.

BACKGROUND OF THE INVENTION

A woven plastic bag has a layer of woven-together plastic strips that are mostly exposed on an inner surface of the bag in sections and partly covered with coatings of plastic.

Specifically, the invention relates to a method of making a woven plastic bag as described in DE 10 2011 080 462 where

- a flat-lying fabric web is fed along a production direction and has on a first top side an exposed layer of woven-together plastic strips, the fabric web extending perpendicular to the production direction along a transverse direction and each extending over 10% of the width of the fabric web and, between them, a middle section, the fabric web being provided with a pattern that repeats in the production direction on the first face of the fabric web of local coatings in the form of a film or of a liquid plastic,
- the fabric web is reshaped into a fabric tube, and
- the fabric web, in order to form individual woven plastic bags, is separated into pieces of the fabric tube that are subsequently filled and sealed.

Woven plastic bags are characterized by good functional characteristics, particularly by a high load capacity. In general, the woven-together plastic strips are connected to a polymer film that forms the outer surface of the woven plastic bag. The polymer film of the outer surface gives the bag a high-quality appearance and seal the bag wall. Moreover, the individual strips of the fabric are fixed to one another, thus stabilizing the weave. The fabric is preferably made of polypropylene.

The fabric and the polymer film forming the outer surface are bonded flatly to each other and form a strong woven plastic laminate. The polymer film can be a separate film and laminated with the fabric or can even be extruded onto the fabric.

In principle, it is possible to also provide a coating, for example in the form of a film, at zones on the inner face of the bag, in which case the material and manufacturing costs rise substantially, however.

If the fabric on the inside of the bag is not provided with a coating, the woven plastic bag is usually sealed together by adhesive strips, because the woven-together plastic strips cannot be reliably and tightly thermal welded.

In order to also enable closing of a woven plastic bag by thermal welds without providing the entire fabric with a coating, a coating is applied only in the form of strips that run transversely on the fabric web when it is lying flat. The strips extend with a constant strip width—i.e., a constant length in the production direction—over nearly the entire width, with the coating either being omitted in the outer edge regions or transitioning into a coating running in the production direction in the manner of a strip.

As a result of the coating running in the transverse direction, a thermal weld can be produced in order to easily seal the woven plastic bag. This offers the advantage that the coating is applied only in places in which a sealing is to be formed, thus resulting in substantial savings in materials.

Like with a woven plastic bag that is provided over the entire inside with a coating and sealed, they must generally be opened with scissors, since it is difficult to tear the woven-together plastic strips.

OBJECTS OF THE INVENTION

It is therefore an object of the present invention to provide an improved woven plastic bag and method of making same.

Another object is the provision of such an improved woven plastic bag and method of making same that overcomes the above-given disadvantages, in particular that is characterized by improved functional characteristics.

SUMMARY OF THE INVENTION

A woven plastic bag is made by feeding in a longitudinal production direction a flat-lying fabric web having a layer of woven-together plastic strips on a first face, opposite longitudinal edge regions spaced from each other perpendicular to the production direction along a transverse direction and each extending over about 10% of a transverse width of the fabric web, and a middle section between the longitudinal edge regions. A pattern is applied the first face of the fabric web in a pattern that repeats along the production direction only locally with a coating in the form of a film or in the form of a liquid plastic of a width or shape that varies in a transverse direction. The fabric web is then shaped into a fabric tube. In order to form individual woven plastic bags, the fabric tube is cut transversely into pieces of the fabric tube suitable for subsequent filling and sealing.

Thus, unlike the prior-art method, according to the invention the application of the coating changes in the middle section in the transverse direction. In this context, the present invention is based on the discovery that both substantial savings in materials and expanded functionalities can be achieved by the varying application in the middle section in the transverse direction. The application of the coating can vary in quantity, course and/or shape. In particular, recesses and steps can be present. The proportion of the surface area provided with the coating with respect to the overall surface area of the fabric web is usually less than 30%, particularly less than 25%, for example between 5% and 20%.

Within the scope of the invention, a film or a plastic is provided as a coating that is applied in a liquid state. The plastic can particularly also be viscous and optionally applied hot or cold. It is possible, for example, to extrude a polymer melt or a hot-melt adhesive in molten liquid form or to apply it using suitable transfer methods such as a transfer roller, for example.

In principle, it is also conceivable to apply a sealing wax cold that first dries and is then still thermally weldable later. Furthermore, an adhesive can also be applied that then brings about a connection later directly during the formation of the film tube, in which case it is preferred, however, that a coating be provided that is intended only for subsequent thermal welding.

In this context, the present invention is also based on the discovery that the coating need not necessarily be joined with itself after the formation of the fabric tube, that is, it need not be present on both of the surfaces of the fabric tube to be joined together. To wit, it is sufficient in order to achieve a connection if the coating is merely present on one of the two surfaces to be interconnected, in which case the coating that is liquefied through the application of heat during thermal welding can then form a close connection to the fabric even on the surface that it initially not coated.

For example, if a simple woven plastic bag is produced in the form of a pillow, it is sufficient if the coating extends in the form of a strip over only about half of the fabric web in the transverse direction. On the other hand, if the woven plastic bag is a side-gusset bag, the coating can be a segmented strip whose segments are arranged such that, in the flat-lying side-gusset bag, at least one side is provided with the coating in all superimposed surfaces to be interconnected.

Against this background, according to a preferred embodiment of the invention the coating is applied in the form of optionally segmented strips running in the transverse direction, the strips extending over only 40% to 60% of the width. In the case of a segmented strip, this information applies to the overall length of all strip segments.

According to another aspect of the present invention, the coating has a first section along the transverse direction and at least one second section adjacent thereto, the first section having a first dimension in the production direction and the second section having a greater dimension. Such a coating also preferably runs straight or at an acute angle in the transverse direction. The strip width thus changes along the course of the coating, i.e. preferably in the transverse direction. As a result, it is possible to locally vary the strength of a connection produced with the aid of the coating. For example, it is possible in relation to the described embodiment to provide a region starting from a bag edge that is sealed only by a narrow joint seam, thus enabling the woven plastic bag to then be pulled open even by hand, whereas, adjacent thereto, the superimposed surfaces are connected by a broad joint seam and are thus permanently fixed.

Thus according to the invention, a fabric tube is formed starting from a flat-lying fabric web, with individual woven plastic bags then being produced from pieces of the fabric tube. Accordingly, the coating is repeated along the production direction in a repeating pattern. Independently of this, the coating can be applied in a liquid state with a coating pattern in the very regions to be coated. This means that no completely continuous layer is present in the regions to be coated. For example, a coating pattern of intersecting strips can be provided that, by virtue of its structure, makes a reliable and tight connection possible even though further savings in material can be achieved by such a coating pattern.

The method according to the invention can be used not only to produce a closure seam in a woven plastic bag. Rather, it is also possible with the aid of the coating to produce angle welds at a bag bottom or to enable other functional elements such as reclosable fasteners, valves or the like to be included in the bag, such that the possible applications of the woven plastic bag are substantially expanded in the framework of the invention.

If the coating is subsequently fused in order to produce a joint seam, there are two different possible approaches in the framework of the invention. For instance, it is possible to fuse the entire coating to form a joint seam. A thermal welding tool can be provided for this purpose, for example, that is larger than the coating, so that the latter is melted over its entire surface. In the framework of such an approach, the shape of the joint seam is dictated by the application and the type of coating.

According to an alternative embodiment of the invention, the at least one joint seam extends in only a portion of the coating. In the framework of such an embodiment, the coating can be provided on a larger surface without having to meet precise specifications for the shape of the coating. For example, if a patch of film forms a coating, it can have a rectangular shape, in which case the exact course of the joint seam is established only upon the fusion of such a film under the application of heat.

As already described above, a plastic melt or a commercially available hot-melt adhesive can be provided as a coating, there being no need according to the invention for a clear distinction between a common polymer material and a hot-melt adhesive. Plastic melts that are worthy of consideration are, particularly, polyolefins such as polyethylene (PE), PE copolymers, polypropylene (PP) or PP copolymers, with particularly low-melting plastics being preferred that can be polymerized with the aid of metallocene catalysts. Preferably, during application of the coating and thereafter, the fabric is melted superficially at most in a preferred thermal fusion of the coating so as not to lose the orientation of the molecules in the individual plastic strips that is crucial for the carrying capacity of the fabric. When applying the coating in a molten liquid state, and during processing as well, it is advantageous to have good flowability so that the coating can also penetrate into the fabric structure.

With respect to the fabric, there is also the advantage that fused material can penetrate into the intermediate spaces of the fabric, thus effecting an especially reliable connection.

Polyolefins, particularly polyethylene, are worthy of consideration for a film as a coating, such a film preferably being affixed with an adhesive, particularly a pressure-sensitive adhesive, to the woven-together plastic strips.

A woven plastic bag has according to the invention a bag wall formed of woven-together layer of plastic strips, and the wall is exposed in sections on an inner surface and provided on the inner surface in sections with coatings of plastic extending transversely between lateral; edges of the wall. Mutually opposite surfaces of the bag wall are connected to each other with the coatings along at least one joint seam that extends transversely and that has at least one step in the transverse direction. Finally, according to the invention, a dimension of the joint seam determined in a longitudinal direction changes at the step. This results in a different width of the joint seam along its transverse course in relation to the joint seam to each side of the step.

As described above, in this way the joint seam can be torn open more easily at the first joint seam section than at the second joint seam section. By using an appropriate longitudinal dimension of the joint seam, i.e. an appropriate width of the joint seam along its course, regions that are connected with different strengths in the transverse direction of the bag can be produced.

In addition and alternatively, the first joint seam section can also run at an acute angle to the longitudinal and transverse direction and/or have a bend. Particularly when the intention is to enable the joint seam to be peeled open or torn apart at the first joint seam section, an oblique or a bend can be advantageous in terms of the transmission of force during opening.

According to a preferred embodiment of the invention, the woven plastic bag is embodied as a side-gusset bag, so that the bag wall then forms front and back panels as well as a first side gusset and a second side gusset, the two side gussets connecting the front and back panels to one another.

In one embodiment of the woven plastic bag as a side-gusset bag, the previously described step is preferably located at an edge of the first side gusset sandwiched between the front and back panels. Provision can then be made that the side-gusset bag is opened by pulling the side gusset initially sandwiched between the front and back panels outward, thus tearing the joint seam open at the first joint seam section.

In order to facilitate such tearing-open, provision can be made that the first side gusset projects at the head region past the front and back panels. The first side gusset can then easily be gripped by a user and pulled outward.

In addition, or alternatively, a notch can be provided in the front and back panels adjacent the first side gusset, the notch making it easier for a user to grip the side gusset and pull it outward.

Furthermore, the object of the invention is also a woven plastic bag with a bag wall to which is laminated a plastic strip, the fabric being exposed in sections on an inner surface and provided in sections with a coating of plastic, mutually opposite surfaces of the bag wall being connected with the coating along at least one joint seam, and the bag wall forming front and back panels as well as a first side gusset and a second side gusset that connect the front and back panels. In the framework of this embodiment according to the invention, obliquely running joint seams are provided on a lower bag section in the region of the side gussets that connect each side gusset to the front and back panels. The joint seams are angled connections for the purpose of facilitating the formation of a standing base in the woven plastic bag embodied as a side-gusset bag.

As explained above, the entire surface of the coating can form a joint seam or several joint seams in all woven plastic bags according to the invention, so that the shape of the joint seam or of the joint seams is dictated by the application of the coating.

Alternatively, in all woven plastic bags according to the invention the at least one joint seam extends on only part of the coating. The coating can thus be applied on a larger surface, for example over the entire width, as a continuous strip or also only locally in a rectangular shape, the course of the joint seam then being determined subsequently by an only partial melting of the coating.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
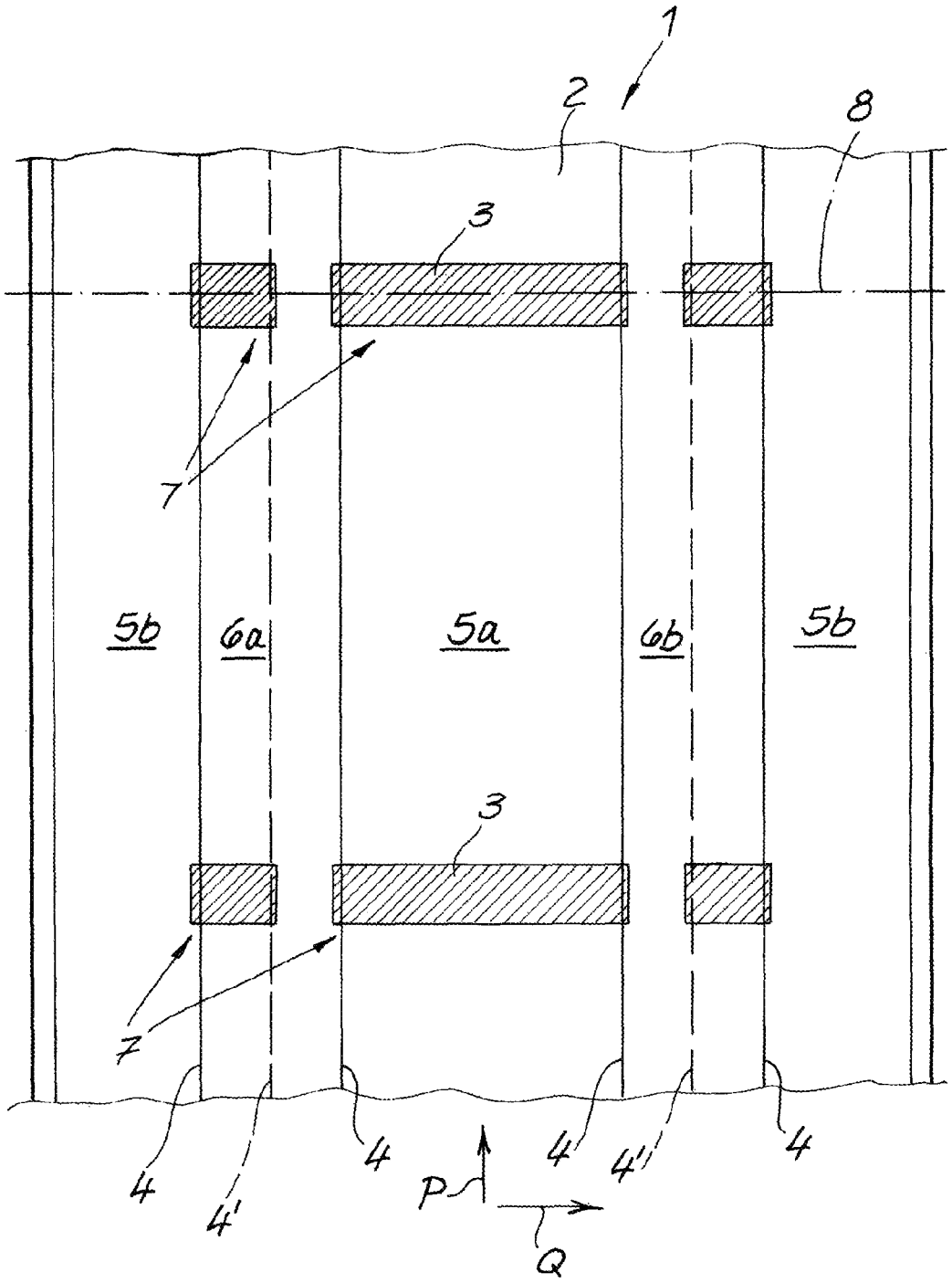
FIG. 1 is an top elevational view of a flat-lying fabric web provided only locally with coatings.

As seen in FIG. 1 a fabric web 1 for making a woven plastic bag moves in a production direction P and has an upper face covered with an initially free and exposed layer 2 formed by woven-together plastic strips. The fabric web 1 is provided with strips or spots of localized coatings 3 on the woven layer 2.

The coatings 3 can for example be formed by pieces of adhered film or a plastic applied in liquid form. Especially preferably, the coatings 3 are applied as a molten liquid plastic that can be extruded in a viscous state or applied by a transfer roller.

Subsequently, the fabric web 1 and its coatings 3 are reshaped in a known manner into a tube. According to the illustrated embodiment, a side-gusset tube for forming side-gusset bags is made from the tubular fabric web 1 by folding along lines 4 and 4' in the still flat-lying fabric web 1. The first fold lines 4 form the transitions from front or back panel 5*a* or 5*b* to side gussets 6*a* and 6*b*, and the two side gussets 6*a* and 6*b* are each folded onto themselves at respective second fold lines 4'. During manufacture, a fin weld is formed at the edges of the fabric web 1, for which reason another thermoplastic coating can also be provided there.

FIG. 1 shows that the coating 3 also changes in the transverse direction Q outside of the edge regions in a middle section of the fabric web 1. Specifically, the coating 3 is subdivided into strips or segments 7 spaced apart in the transverse direction Q, the segments 7 extending over somewhat more than 50% of a width of the fabric web 1 in the transverse direction Q. If the fabric web 1 is reshaped along the fold lines 4 and 4' into a side-gusset tube, surfaces then oppose each other at the level of the coating 3 over the entire width of the side-gusset tube, at least one of which is provided with a coating 3, so that a tight weld can be achieved by fusing together the coatings 3.

The coatings 3 thus fulfill the purpose of an adhesive that is present in only a single layer and then connects faces to be joined of the woven layer 2. The illustrated embodiment therefore differs from an embodiment in which, according to the prior art, a continuous strip is provided as a coating that is then connected only to itself.

FIG. 1 shows a cutoff line 8 running in the transverse direction Q at which individual pieces are then separated from the fabric tube. When the fabric tube is separated at the cutoff line 8, a head seam or a bottom seam can be produced on successive woven plastic bags with the coating 3 that is severed at that point.

FIG. 1 shows the surface of the web 2 that forms the inner face of the finished bag. Thus side gussets are formed by first raising the web 1 at the side gusset seams 4' to fold the regions 6*a* an 6*b* up and over onto the middle region 451, whereupon the outer regions 5*b* of the back panel are folded over on to the middle region and the folded together gusset regions 6*a* and 6*b*. The segments 7 thus allow a complete closure of the tube at both longitudinal ends at the cutoff lines 8, it being presumed that the longitudinal edges are welded together in the normal manner.

Figure 2:
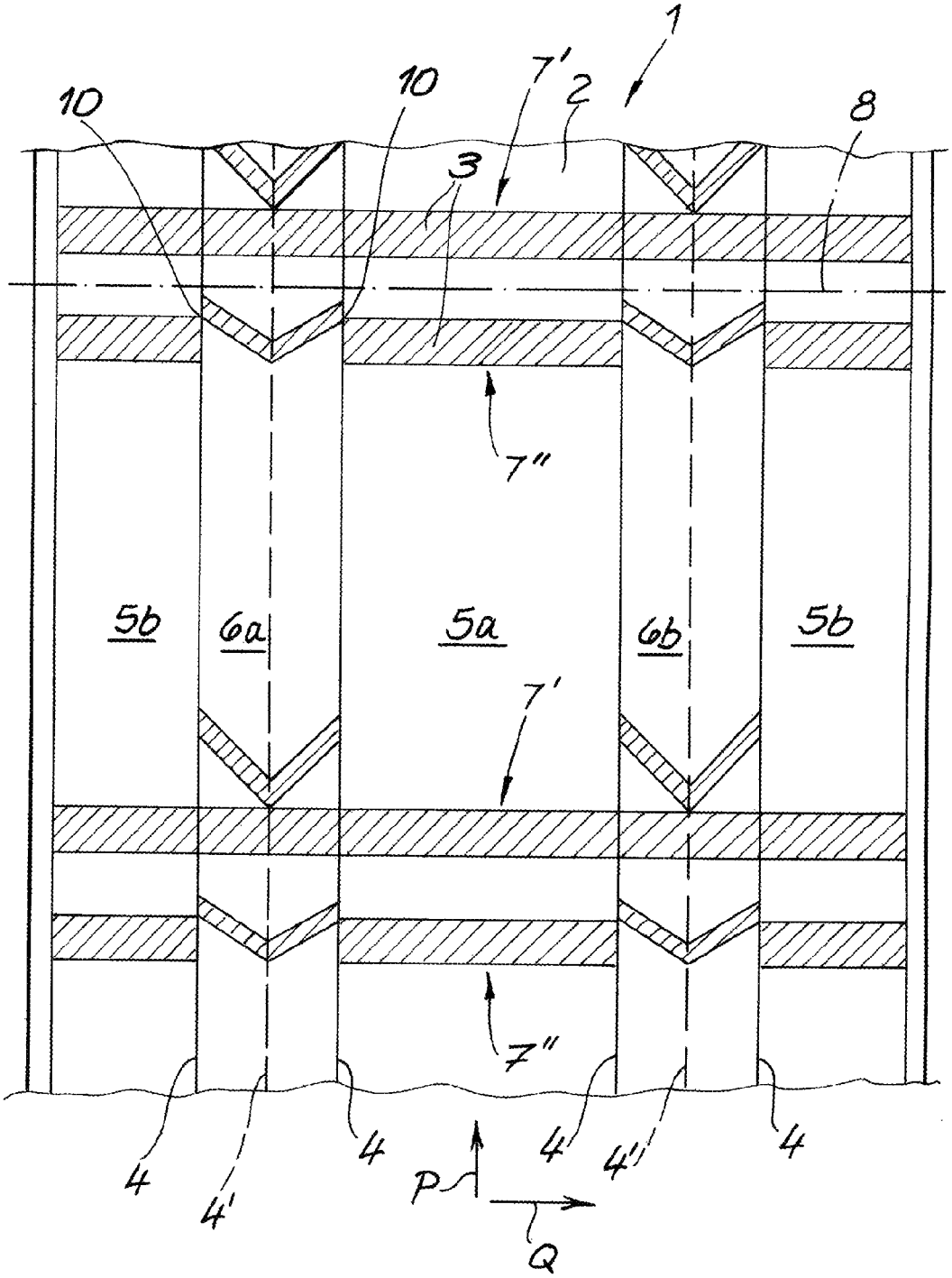
FIGS. 2 to 4 are views like FIG. 1 of embodiments of the coatings.

FIG. 2 shows an alternative embodiment for the sake of example in which the coatings form different structures. In addition to a transversely continuous strip 7' forming a bottom seam and embodied according to the prior art, an additional strip 7" formed with steps 10 is provided to form a joint seam 9 (FIG. 5) at a head region of the woven plastic bag. The extension of the coating 3 along the production direction P, which also corresponds to a longitudinal direction L of the woven plastic bag in the embodiment, changes at the steps 10. In other words, the corresponding strip 7" has a region along its course that has, at the side gussets, a lesser strip width and also runs at an acute angle. As will also be described below in relation to FIG. 5, this ensures that the section with a lesser strip width can easily be pulled open at the first side gusset 6*a*.

Furthermore, FIG. 2 shows that other shapes, such as oblique shapes, for example, can also be formed with the coating 3 applied only in sections at which joint seams 9' are subsequently formed in the form of corner joints.

Figure 3:
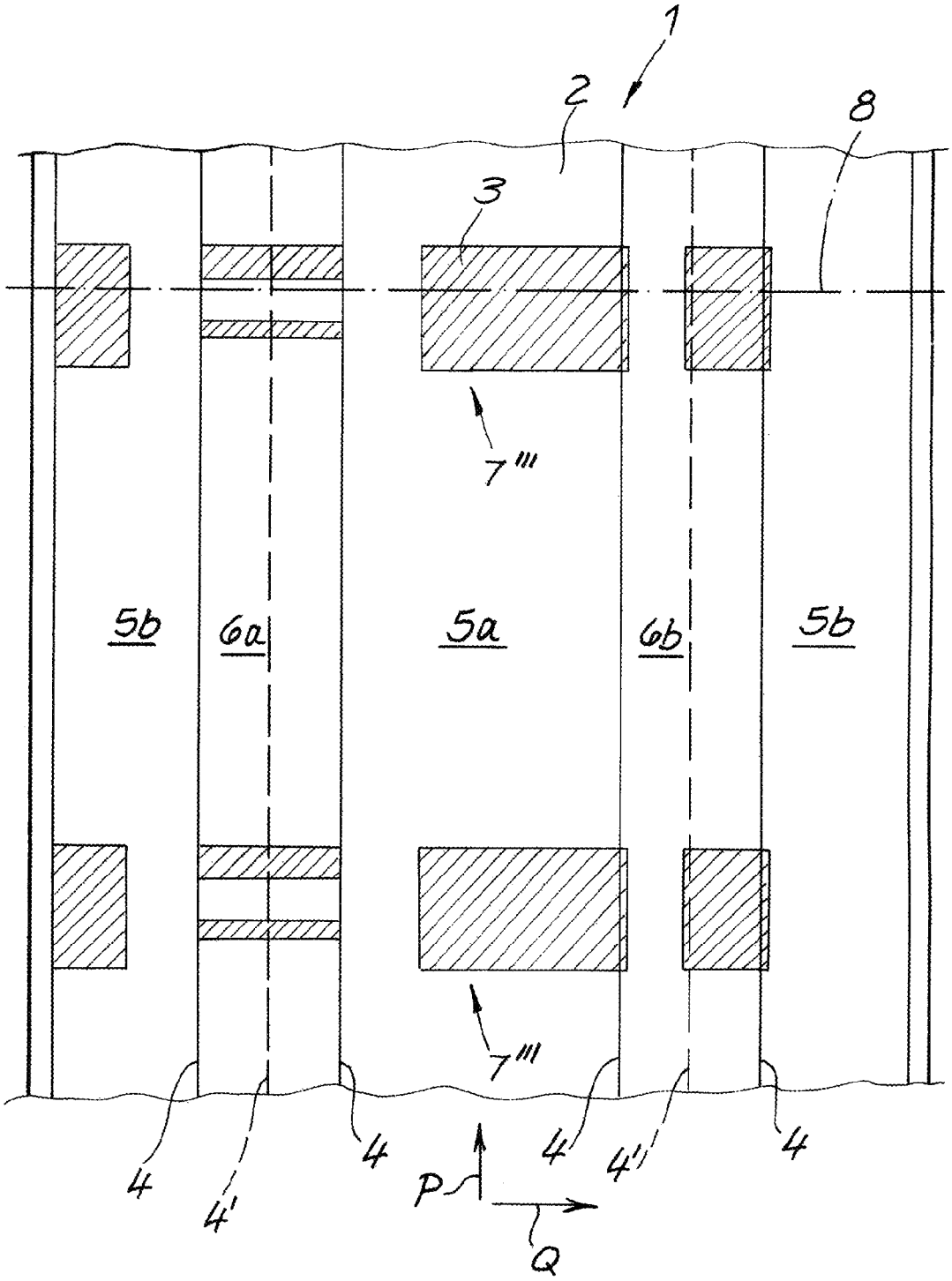

Finally, FIG. 3 shows a combination of the features of FIGS. 1 and 2 according to which the coating 3 is a segmented strip 7''' that has gaps and also changes shape along the production direction P and thus also along the longitudinal direction L of the woven plastic bag to be produced. Here the strip 7''' is of maximum thickness over most of the region corresponding to the face panel and one of the side gussets, but is divided into a medium-width strip and a parallel minimum-width strip in the other side gusset, flanking the cut line 8. The resultant bag therefore is solidly and continuously sealed closed at a bottom edge, but at a top edge is only lightly secured together by the minimum-width strip so it can be pulled apart and the bag's contents can be poured out of a spout formed by the pulled-out and separated gusset.

In the embodiments according to FIGS. 1 to 3, it is possible to form joint seams 9 and 9' (FIG. 5) on the coatings at the bottom of the side gussets to create a bag that can stand up.

It is also possible, however, to apply a coating 3 over a greater surface and to then establish the shape of the joint seam 9 or 9' subsequently according to the shape of a thermal welding tool or the like.

Figure 4:
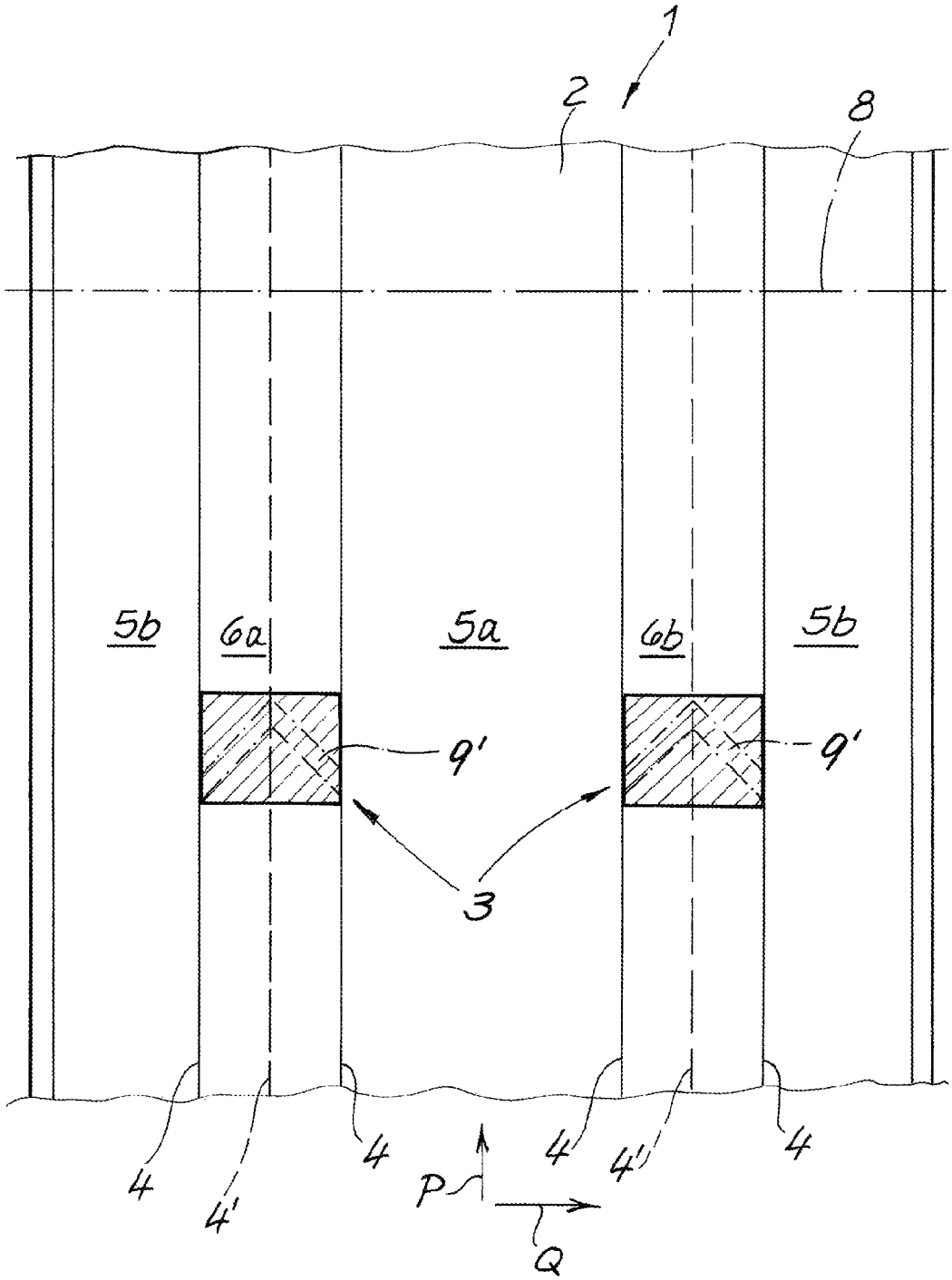

According to FIG. 4, the coating 3 is thus formed on the woven layer 2 in the form of a rectangular spot, the oblique joint seams 9' that are to be formed only later being indicated.

The production of joint seams 9 and 9' in only a portion of the coating 3 can also be provided without restriction in the head region of a woven plastic bag. For instance, starting from FIG. 2, a provision can be made that the coating 3 is applied as a wide strip running in the transverse direction Q, in which case the structures indicated in FIG. 2 are formed subsequently only by the shape of a thermal welding tool that has a narrower width than the coating it is applied to.

Figure 5:
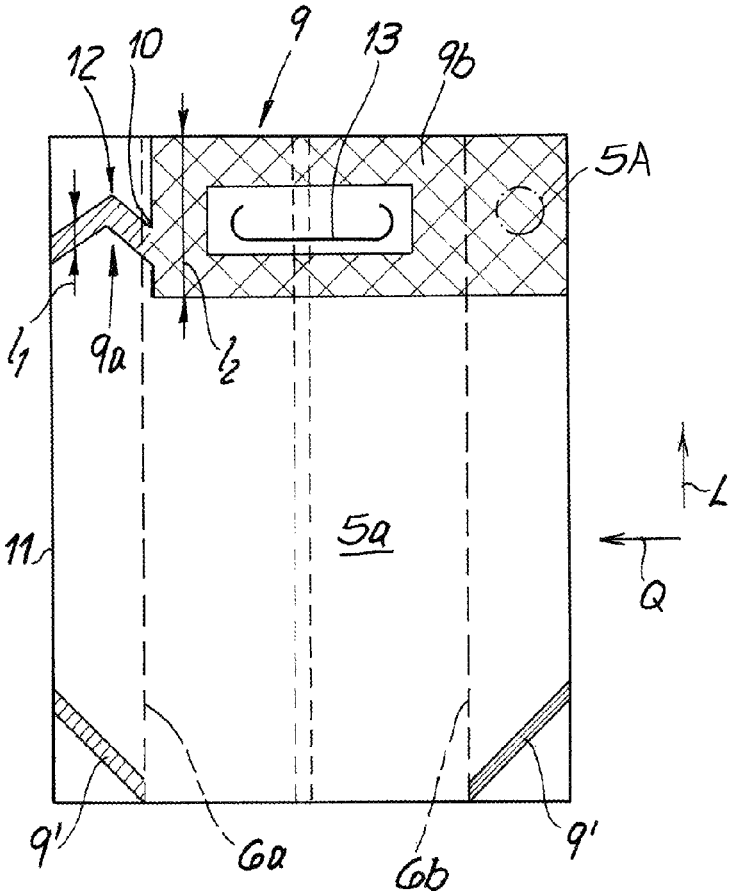
FIG. 5 is an elevational view of a woven plastic bag that has been laid flat.
Figure 5A:
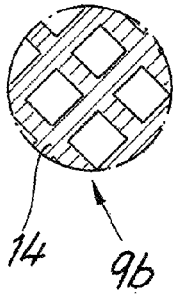
FIG. 5A is a large scale view of the detail of FIG. 5 indicated at VA.

Finally, FIG. 5 shows a woven plastic bag with a bag wall that has a plastic woven layer 2 as described above that is partially exposed at an inner surface of the woven plastic bag and partially covered by coatings 3 of plastic, and opposite surfaces of the bag wall are connected to each other with the coatings 3 along several joint seams 9, 9'.

A joint seam 9 seals the woven plastic bag in the transverse direction Q. The joint seam 9 has a step 10 in the transverse direction Q, the height of the joint seam 9 determined along the longitudinal direction L changing at the step 10. Specifically, the joint seam 9 has a first dimension $l_1$ in a longitudinal direction L at a first joint seam section 9*a* starting from a lateral bag edge 11 running in the longitudinal direction L and a larger longitudinal dimension $l_2$ at a second joint seam section 9*b* adjacent thereto at the step 10. In other words, the width of the joint seam 9 changes at the step 10 along the transverse extent of the joint seam 9.

Moreover, it can be seen that the first, narrower joint seam section 9*a* runs at an acute angle and is also provided with a bend 12. Due to the lesser width of the first joint seam section 9*a*, it can be pulled open by a user, whereas the second joint seam section 9*b* ensures a secure closure of the woven plastic bag. In order to pull the first joint seam section 9*a* open, a user can grip the first side gusset 6*a* and pull it outward.

FIG. 5 also shows that the woven plastic bag can also have a hand hole 13 on its upper bag edge, the coating 3 optionally being omitted at the hand hole 13 but otherwise forming the seam 9.

FIG. 5 also shows joint seams 9' in the form of angle welds at the ends of the side gussets.

Within the scope of the invention, the coating 3 can also be applied on the faces to be coated in an openwork coating pattern 14 as indicated in FIG. 5 formed by crossing but spaced lines of the coating.

With regard to the structure of the joint seams 9 and 9' illustrated in FIG. 5, it should be noted that this structure can be precisely established on application of the coating, particularly if a joint seam 9 or 9' or several joint seams 9 and 9' are formed on the entire surface of the coating 3.

It is also possible, however, for the joint seams 9 and 9' to be produced on only a portion of the coating 3. This then results in the advantage that somewhat larger regions can be coated during application of the coating without having to pay special attention to precision. As regards the shape of the joint seams 9 and 9', several possible variations generally also exist in relation to such an approach.

Figure 6:
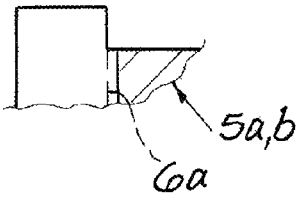
FIGS. 6 and 7 show optional embodiments of details of the woven plastic bag shown in FIG. 5.
Figure 7:
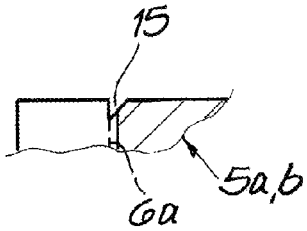

In order to make it easier to grip the first side gusset 6*a* in an embodiment according to FIG. 5, it can also be embodied according to FIG. 6 such that it extends beyond the front and rear panels 5*a* and 5*b* or at least the region of the front and rear panels 5*a* and 5*b* adjacent the first side gusset 6*a*.

In addition, or alternatively, a notch 15 can also be provided in the front and rear panels 5*a* and 5*b* adjacent the first side gusset 6*a* in order to make the side gusset 6*a* easier to grip.

We claim:

1. A method of making a woven plastic bag, the method comprising the steps of:

feeding in a longitudinal production direction a flat-lying fabric web having a layer of woven-together plastic attachment strips on a first face, opposite longitudinal edge regions spaced from each other perpendicular to the production direction along a transverse direction and each extending over only part of a transverse width of the fabric web, and a middle section between the longitudinal edge regions;

applying to the first face of the fabric web a pattern that repeats along the production direction only locally with a coating in the form of a film or in the form of a liquid plastic of a width or shape that varies in a transverse direction;

shaping the fabric web into a fabric tube;

in order to form individual woven plastic bags, cutting the fabric tube transversely into pieces of the fabric tube suitable for subsequent filling and sealing;

connecting together mutually opposite surfaces of the bag wall with the coating along at least one joint seam that extends transversely; and forming the joint seam with at least one step in the transverse direction such that a dimension of the joint seam determined in a longitudinal direction changes at the step.

2. The method defined in claim 1, wherein the coating is applied as a first section and a second section adjacent thereto along the transverse direction, the first section having a first dimension in the production direction and the second section having a greater second dimension.

3. The method defined in claim 1, wherein the coating is applied at least in sections at an acute angle with respect to the production direction and the transverse direction.

4. The method defined in claim 1, further comprising the step, after shaping of the web into the fabric tube, of:

fusing the coating to form a connection within the fabric tube between superimposed layers of the fabric web.

5. The method defined in claim 1, wherein the web is shaped into a side-gusset tube.

6. The method defined in claim 1, wherein the coating is applied in a liquid state with the pattern.

7. The method defined in claim 1, further comprising the step of:

imparting to the joint seam a first dimension in the longitudinal direction at a first joint seam section starting from one of the lateral bag edges extending in the longitudinal direction and a greater dimension at a second joint seam section adjacent thereto at the step.

8. The method defined in claim 7, further comprising the step of:

orienting the first joint seam section at an acute angle with respect to longitudinal and transverse directions of the wall or forming it with a bend.

9. The method defined in claim 1, wherein the fabric tube into which the fabric web is shaped has a front panel, a back panel, and first and second side gussets that connect the front panel and the back panel.

10. The method defined in claim 1, wherein the fabric tube into which the fabric web is shaped has a front panel, a back panel, and first and second side gussets that connect the front panel and the back panel and the step is on an edge of the first side gusset sandwiched between the front panel and the back panel.

11. The method defined in claim 10, wherein the first side gusset projects at a head region past the front and back panels.

12. The method defined in claim 11, further comprising the step of:

forming a hand hole on the head region.

13. The method defined in claim 10, further comprising the step of:

forming a notch in the front and back panels adjacent the first side gusset.

14. The method defined in claim 1, wherein an entire surface of the coating forms the joint seam.

15. The method defined in claim 1, wherein the joint seam is only extended into a portion of the coating.

* * * * *